US009382727B2

(12) United States Patent
Lundberg

(10) Patent No.: US 9,382,727 B2
(45) Date of Patent: Jul. 5, 2016

(54) CYLINDER CORE FOR A CYLINDER FOR LOCKS

(71) Applicant: DORMA Deutschland GmbH, Ennepetal (DE)

(72) Inventor: Lars Lundberg, Västra Frölunda (SE)

(73) Assignee: DORMA DEUTSCHLAND GMBH (DE)

( * ) Notice: Subject to any disclaimer, the term of this patent is extended or adjusted under 35 U.S.C. 154(b) by 0 days.

(21) Appl. No.: 14/833,674

(22) Filed: Aug. 24, 2015

(65) Prior Publication Data

US 2016/0060900 A1 Mar. 3, 2016

(30) Foreign Application Priority Data

Aug. 26, 2014 (DE) ..... 10 2014 112 219

(51) Int. Cl.
*E05B 27/00* (2006.01)
*E05B 15/08* (2006.01)

(52) U.S. Cl.
CPC ..... *E05B 27/0017* (2013.01); *E05B 15/08* (2013.01)

(58) Field of Classification Search
CPC ..... Y10T 70/7605; Y10T 70/7599; Y10T 70/765; Y10T 70/7684; Y10T 70/7565; Y10T 70/7638; Y10T 70/7661; Y10T 70/7701; Y10T 70/7667; Y10T 70/7864; Y10T 70/7588; Y10T 70/8595; Y10T 70/7678; Y10T 70/7644; Y10T 70/7802; E05B 9/086; E05B 9/084; E05B 29/004; E05B 27/0007; E05B 63/0056; E05B 9/10; E05B 27/0017; E05B 15/08
USPC ..... 70/490, 492, 493, 372, 375, 367, 369
See application file for complete search history.

(56) References Cited

U.S. PATENT DOCUMENTS 1,922,889 A * 8/1933 Falk ..... E05B 9/086 70/368
1,987,735 A * 1/1935 Falk ..... E05B 9/086 384/368
2,766,611 A * 10/1956 Hagel ..... E05B 29/00 70/375
3,736,780 A * 6/1973 Singer ..... E05B 15/08 70/382
3,863,476 A * 2/1975 Patriquin ..... E05B 29/00 70/375
4,395,893 A * 8/1983 Steinbach ..... E05B 29/00 70/373
5,088,306 A * 2/1992 Field ..... E05B 15/08 29/401.1
5,431,034 A * 7/1995 Fann ..... E05B 9/086 70/337
5,475,997 A * 12/1995 Chung ..... E05B 27/001 70/358
5,927,115 A * 7/1999 Feder ..... E05B 15/08 70/419
6,058,752 A * 5/2000 Feder ..... E05B 15/08 70/419
6,155,090 A * 12/2000 Rubensson ..... E05B 15/08 70/367
6,314,774 B1 * 11/2001 Andersson ..... E05B 27/0053 70/357
6,722,171 B1 * 4/2004 Ruan ..... E05B 17/04 70/371
6,758,073 B2 * 7/2004 Yu ..... E05B 27/001 70/358
7,260,965 B2 * 8/2007 Hung ..... E05B 31/00 70/339

* cited by examiner

*Primary Examiner* — Suzanne Barrett
(74) *Attorney, Agent, or Firm* — Cantor Colburn LLP

(57) ABSTRACT

A cylinder core for a cylinder for locks, including a key profile insert inserted in a cylinder core body, the key profile insert having at least one first core pin and the cylinder core body having a first pin channel, a second pin channel, and at least one second core pin, where the first pin channel aligns with the first core pin and the second pin channel guides the second core pin and where the first core pin and the second core pin are movable within the first pin channel and the second pin channel by a key which is insertable into the cylinder core.

10 Claims, 4 Drawing Sheets

CYLINDER CORE FOR A CYLINDER FOR LOCKS

CROSS REFERENCE TO RELATED APPLICATION

This application is related to and claims the benefit of German Patent Application Serial Number 102014112219.4 filed on 26 Aug. 2014, the contents of which are herein incorporated by reference in their entirety.

TECHNICAL FIELD

The present invention regards a cylinder core for a cylinder for locks. Further, the invention concerns a lock comprising said cylinder core.

BACKGROUND

Locks are commonly used to only allow authorized persons entering a door. Such authorized persons use a key to unlock the door such that the door can be opened. In the other way, the door can be kept in a closed state by locking the door with the key. In general, a lock comprises a cylinder body and a cylinder core. The cylinder core defines which kind of key is to be used with the lock. However, there are a lot of different standardizations in which way a cylinder core is connected to a lock cam which activates or deactivates a locking mechanism of the door. Therefore, different cylinder cores need to be provided for each global market, since different global markets apply different standardizations.

Further, general locks are usually not withstanding abuse which is directed to pull the cylinder core out of the cylinder body. Therefore, it is not guaranteed that a locked door remains locked for all unauthorized persons.

BRIEF SUMMARY

Herein, a cylinder core is provided for a lock which is flexible to install, flexible to set up a huge verity of key authorizations and which provides a safe and secure lock with extra protection for attack and abuse against the cylinder core.

More specifically, a cylinder core for a lock is provided comprising a key profile insert inserted in a cylinder core body. The key profile insert has at least one first core pin. The cylinder core body has at least a first pin channel, a second pin channel and at least one second core pin. The key profile insert is preferably insertable into the cylinder core body. In this case, the first pin channel of the cylinder core body aligns with the first core pin of the key profile insert. The second pin channel of the cylinder core body guides the second core pin. Further, the first core pin and the second core pin are movable within the first pin channel and the second pin channel, respectively, by a key which is insertable into the cylinder core. In a preferred embodiment, all core pins are adjusted by inserting the key such that no other pins can be inserted into the first pin channel and the second pin channel from outside the cylinder core. In case the key is removed from the cylinder core, pins can be inserted from outside the cylinder core into the first pin channel and the second pin channel such that a rotation of the cylinder core within a cylinder body is prevented. Preferably, the cylinder core body is a cylindrical body having a cylindrical recess within, such that the key profile insert, which preferably also is a cylindrical body, can be inserted into this recess. It is advantageous if an axis of the key profile insert and an axis of the cylinder core body are orientated in parallel to each other.

Preferably, only the key profile insert defines a key way. The key way only allows a specific key to be inserted into the cylinder core, i. e. the key being adapted to the specific key way. Therefore, the cylinder core can be adapted to any key by providing a specific key profile insert. The cylinder core body does not need to be changed. Therefore, there can be provided one single cylinder core body for a various number of different key profile inserts. Therefore, a various number of different cylinder cores can be manufactured from a single type of cylinder core body. Hence, the cylinder core provides a flexible setup for low costs.

It is advantageous if the core body comprises a key guiding part. The key guiding part is provided for guiding the key through the core body and the key profile insert. In particular, the key guiding part is similar for any type of keys which could be inserted into the cylinder core. Therefore, it is ensured that the key fits into the cylinder core without wedging or being loose inside the cylinder core.

In order to position the key profile insert within the cylinder core body, the key profile insert preferably comprises a positioning element. The positioning element is provided within a positioning channel of the cylinder core body. Preferably the positioning element prevents rotation of the key profile insert relative to the cylinder core body.

Further, it is advantageous to provide at least one guiding pin with the key profile insert. In a specific embodiment, there are two guiding pins provided with the key profile insert. The al least one guiding pin is orientated perpendicular to the first core pin and/or the second core pin. Preferably, the guiding pin is provided on a base face of the cylindrical key profile insert and is insertable into a hole of the cylinder core body. Therefore, the guiding pin prevents rotation of the key profile insert relative to the cylinder core body.

Preferably, the key profile insert comprises at least one fixing pin, preferably at least one fixing brass pin, wherein the fixing pin prevents movement of the key profile insert relative to the cylinder core body. In a preferred embodiment, the cylinder core body provides a hole which aligns to a hole of the key profile insert. The fixing pin can then be inserted into the hole of the cylinder core body and the key profile insert. In a further specific embodiment, the fixing pin is orientated in a radial direction of the cylinder core body or the key profile insert. In any case, the fixing pin is inserted from the curved surface area of the cylinder core body. Therefore, the fixing pin prevents rotation of the key profile insert as well as any longitudinal movement of the key profile insert with relation to the cylinder core body. In a yet preferred embodiment, there are provided at least two fixing pins.

The invention further regards a lock. The lock comprises a cylinder core as described above. Further, the lock comprises a cylinder body for housing the cylinder core. Finally, the lock comprises an adapter element allowing connection of the cylinder core with a lock cam or a cylinder follower element. Due to the adapter element, the cylinder core can be used for various standardizations. With the adapter element, only one single type of cylinder core has to be provided for all different standardizations. Therefore, the lock provides a very flexible and variable setup for very low costs. Further, it can be seen that the inventive cylinder core body is one standardized element which can be used for all kinds of different locks. If a key way shall be changed, a new key profile insert can be inserted into the cylinder core body. In case the connection to the disk cam or cylinder follower element shall be changed, a different adapter element could be employed.

The adapter element preferably comprises at least one mounting hole for fixing the adapter element to the cylinder core. In a preferred embodiment, the adapter element comprises two mounting holes.

Preferably, the cylinder core comprises at least one thread. In particular, the cylinder core body comprises said thread. The thread is preferably a tapered hole or a threaded bar. In any case, the thread aligns with the mounting hole of the adapter element. Therefore, the cylinder core, especially the cylinder core body, can be used for different standardizations. There only needs to be provided an adapter element having a respective mounting hole aligning with the thread of the cylinder core or cylinder core body.

The adapter element preferably comprises at least one protrusion. The protrusion is provided within a recess of the cylinder core, in particular of the cylinder core body. Therefore, rotation of the adapter element with respect to the cylinder core is prevented.

BRIEF DESCRIPTION OF THE DRAWINGS

In the following, preferred exemplary embodiments of the invention are explained with the reference to the drawings. In the drawings.

DETAILED DESCRIPTION

Figure 1:
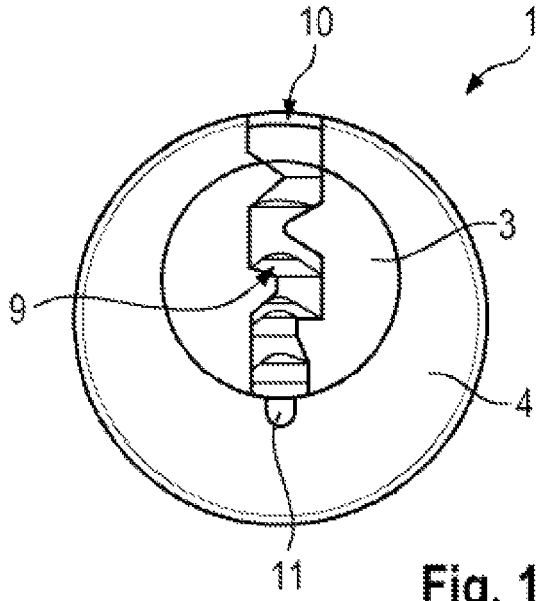
FIG. 1 is a schematic drawing showing an exemplary embodiment of the cylinder core according to the invention.

FIG. 1 shows a cylinder core 1 according to an exemplary embodiment of the present invention. The cylinder core 1 comprises a cylinder core body 4 and a key profile insert 3. The cylinder core body 4 is a cylindrical body having a cylindrical recess on one of the base faces of the cylindrical body. Within this recess, the cylindrical key profile insert 3 can be provided.

The cylinder core body 4 does not provide any specific key way, but rather a key guiding part 10. The key guiding part 10 allows any key to be inserted into the cylinder core body 4. In order to restrict the number of possible keys, the key profile insert 3 provides a key way 9. The key way 9 allows only keys adapted to this specific key way 9 to be inserted into the cylinder core 1. Therefore, any change of the key profile insert 3 results in that different keys need to be provided to operate the cylinder core 1.

Figure 2:
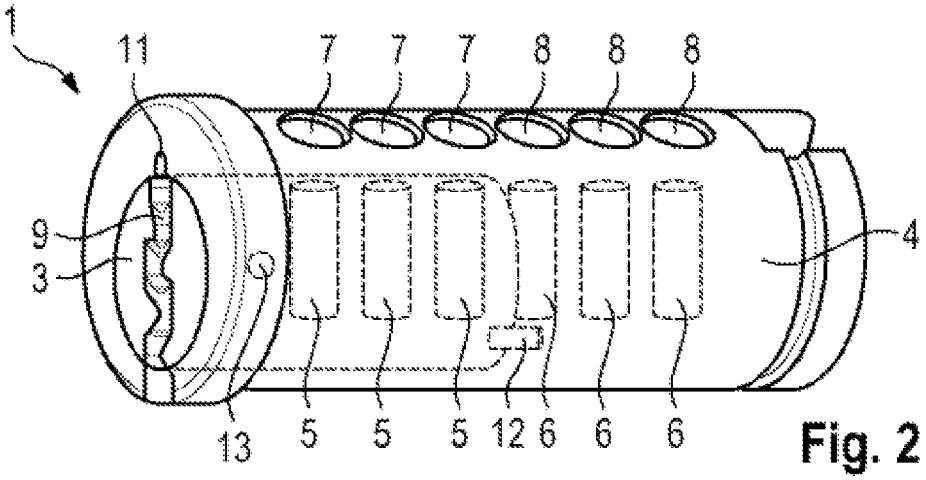
FIG. 2 shows the cylinder core of FIG. 1 from a different angle.

FIG. 2 shows the cylinder core 1 form a different angle. It can be seen that the cylinder core 1 comprises three first pin channels 7 and three second pin channels 8. The three second pin channels 8 guide three second core pins 6. The three second core pins 6 are provided within the cylinder core body 4.

On the other side, the three first pin channels 7 align with three first core pins 5 provided within the key profile insert 3. When inserting a key into the cylinder core 1, the key will reach through the key profile insert 3 into the cylinder core body 4. In this way, all core pins, i. e. the first core pins 5 and the second core pins 6 are adjustable by inserting the key. Only when the correct key is inserted, the first core pins 5 fill the first pin channels 7 and the second core pins 6 fill the second pin channels 8 such that no other pins can be inserted into the first pin channels 7 and the second pin channels 8. If the correct key is removed from the cylinder core 1, additional pins could be inserted into the first pin channels 7 and/or the second pin channels 8. Therefore, a rotation of the cylinder core 1 is prevented.

In order to align the key profile insert 3 within the cylinder core body 4, there are provided two guiding pins 12 which are placed on a base face of the cylindrical key profile insert 3. The guiding pins 12 are insertable into respective holes of the cylinder core body 4. Therefore, a rotation of the key profile insert 3 respective to the cylinder core body 4 is prevented. Additionally, there is a positioning element 11 provided on the key profile insert 3. The positioning element 11 is insertable into a positioning channel of the cylinder core body 4. Therefore, the cylinder core body 4 prevents the key profile insert 3 from rotation.

Finally, the key profile insert 3 provides a fixing brass pin 13. The fixing brass pin 13 is insertable from an outer surface of the cylinder core body 4 into both, the cylinder core body 4 and the key profile insert 3. Therefore, the key profile insert 3 and the cylinder core body 4 each have a hole which align to each other. When inserting the fixing brass pin 13, any rotational and longitudinal movement of the key profile insert 3 with respect to the cylinder core body 4 is prevented. Preferably, there are at least two fixing brass pins 13 provided with the key profile insert 3.

Figure 7:
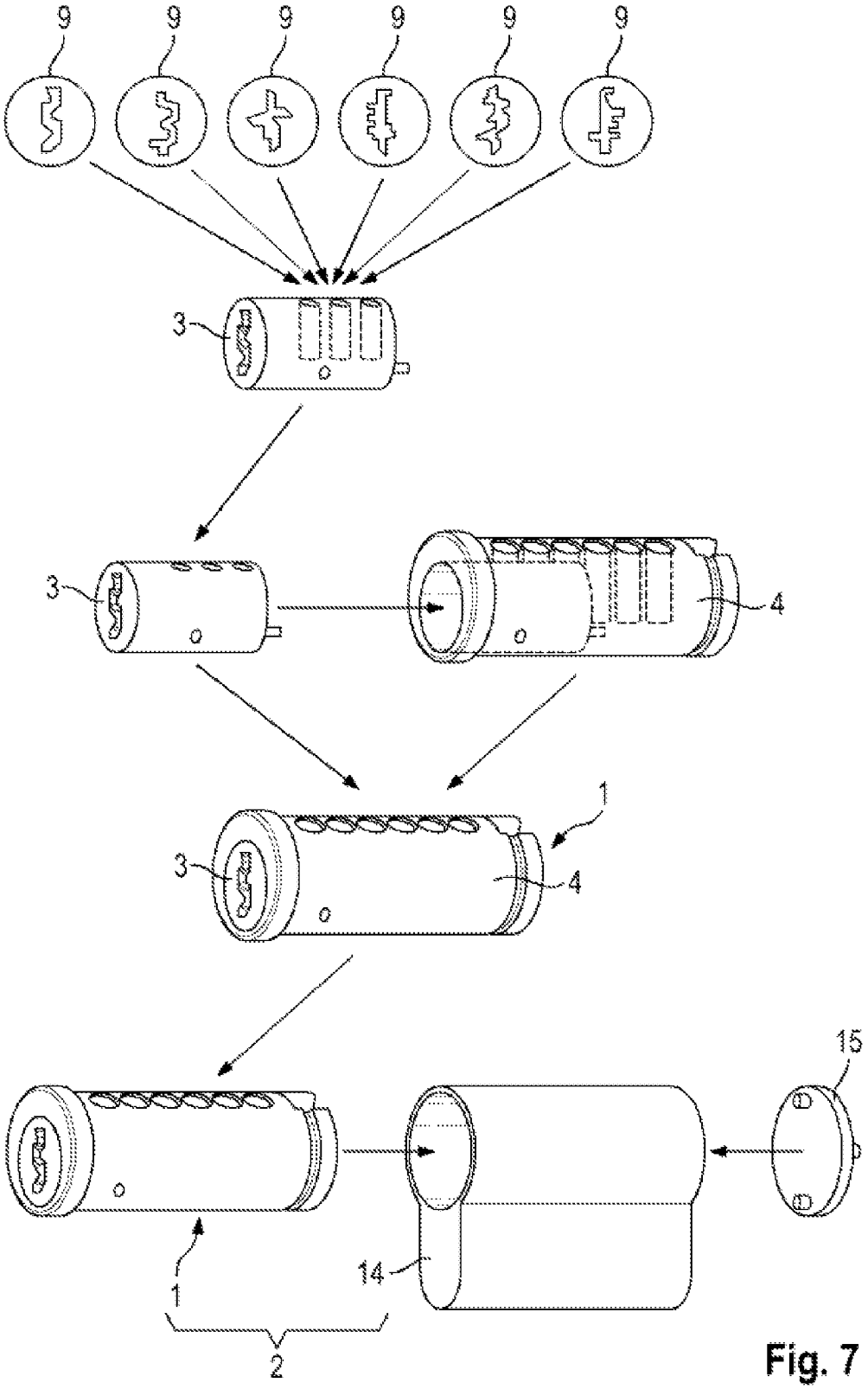
FIG. 7 is a schematic drawing showing the manufacturing process of a lock according to an exemplary embodiment of the invention.

In order to provide a lock 2 (cf. FIG. 7), the cylinder core 1 has to be inserted into a cylinder body 14 (cf. FIG. 7). In order to transmit a movement of the cylinder core 1 to a locking mechanism, for example to a locking mechanism of a door, a lock 2 usually provides a lock cam or a cylinder follower element. The inventive lock 2 according to a preferred exemplary embodiment allows coupling of the cylinder core 1 to various number of different lock cams or cylinder follower elements. Therefore, an adapter element 15 is provided.

FIGS. 3, 4, 5, and 6 show different embodiments of a cylinder core 1 being equipped with such an adapter element 15. The figures do only differ in a different type of adapter element 15.

Figure 3:
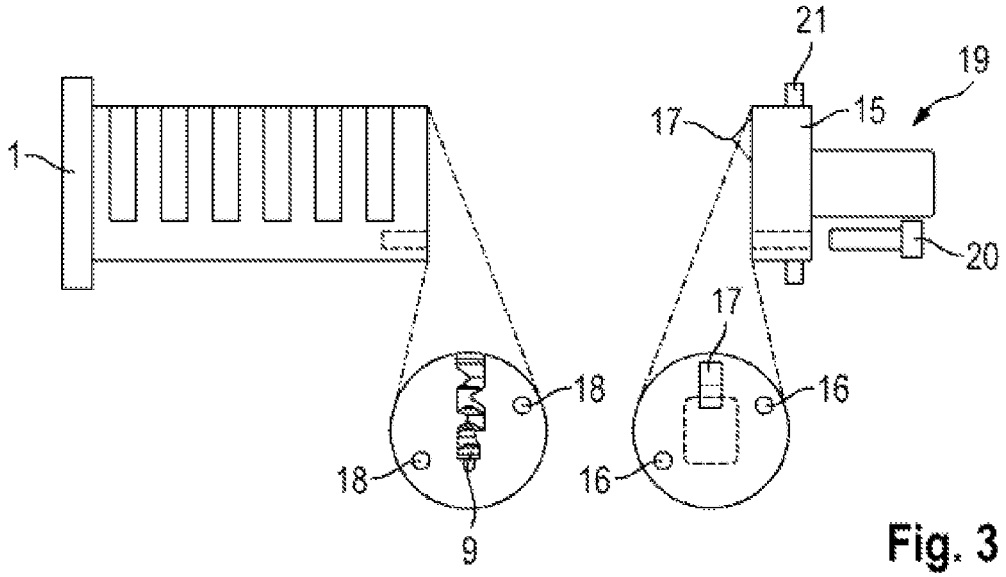
FIG. 3 is a schematic drawing showing a first embodiment of the cylinder core with an adapter element according to the invention.
Figure 4:
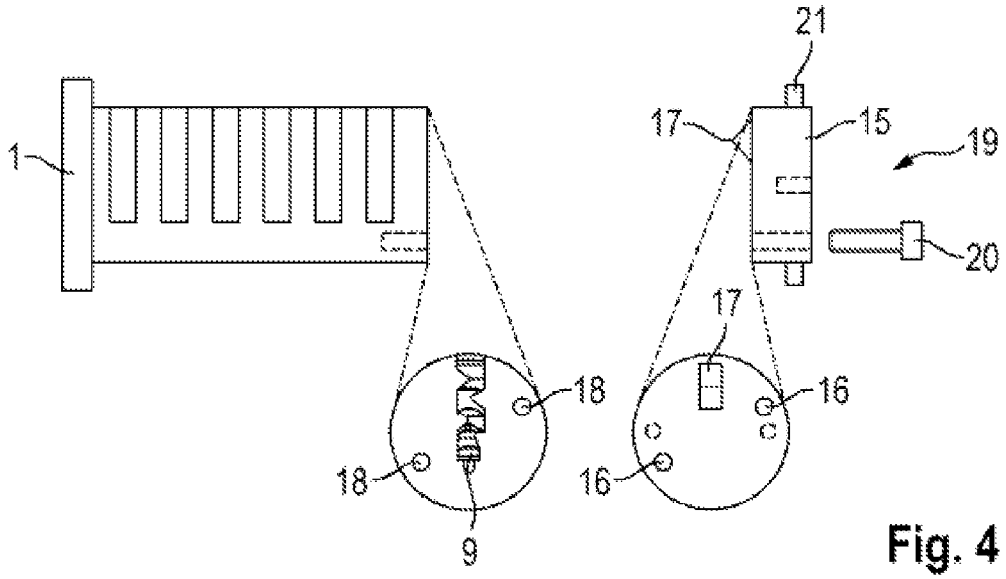
FIG. 4 is a schematic drawing showing a second embodiment of the cylinder core with an adapter element according to the invention.
Figure 5:
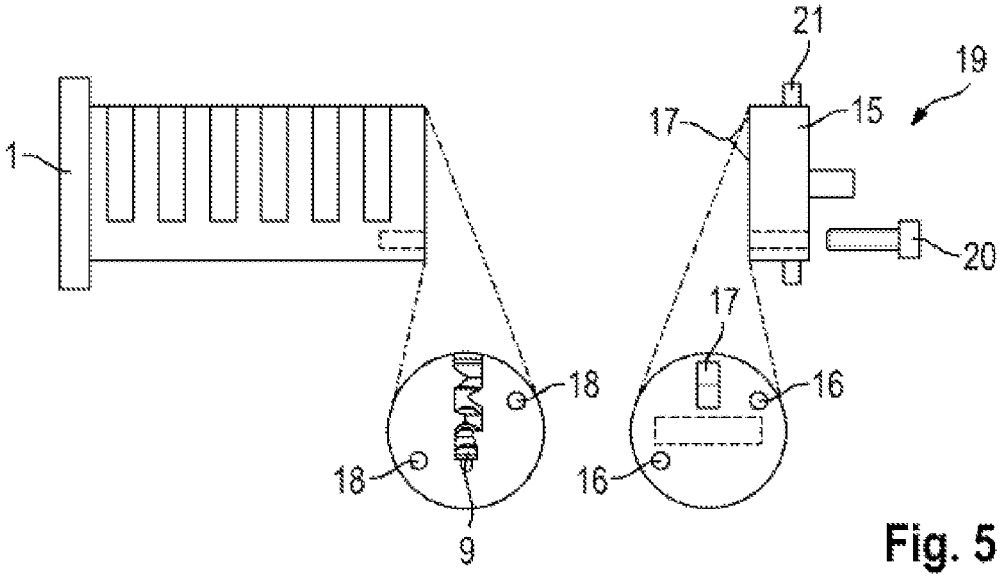
FIG. 5 is a schematic drawing showing a third embodiment of the cylinder core with an adapter element according to the invention.
Figure 6:
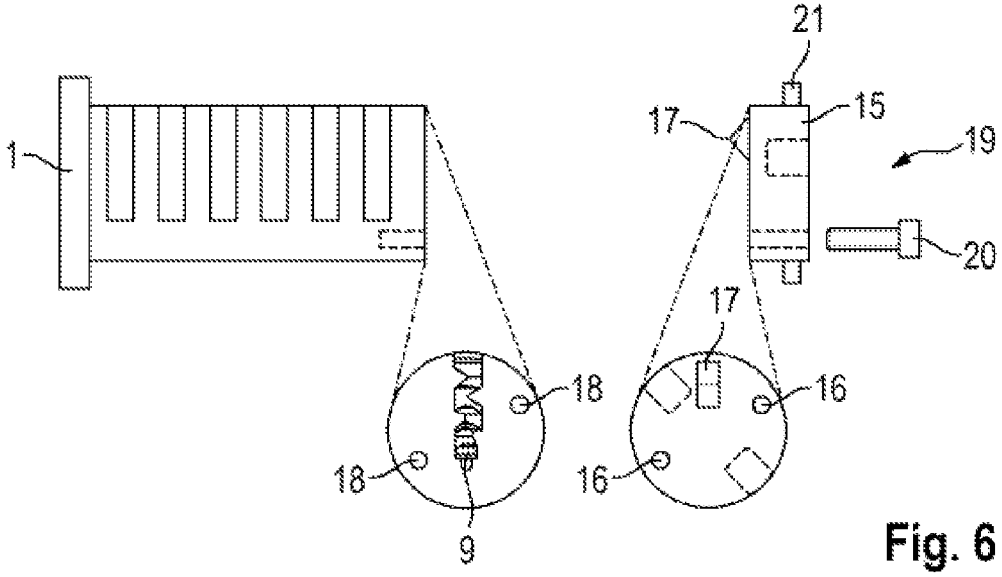
FIG. 6 is a schematic drawing showing a fourth embodiment of the cylinder core with an adapter element according to the invention.

FIG. 3 shows a first exemplary embodiment. As can be seen from this figure, a base face of the cylinder core 1, to which the adapter element 15 shall be mounted, comprises two threads 18 which are represented by two tapered holes. Further, the key way 9 can be seen from this base face. Additionally, FIG. 3 shows a base face of the adapter element 15. The base face of the adapter element 15 comprises one protrusion 17, which is pushed into the cylinder core 1. In this way, a recess is created within the cylinder core 1. Further, the base face of the adapter element 15 comprises two mounting holes 16 which align with the threads 18 of the cylinder core 1. Therefore, fixing screws 20 can be used to fix the adapter element 15 to the cylinder core 1.

The adapter element 15 comprises a cam connector side 19, which is opposite to the base face being connected to the cylinder core 1. The cam connector side 19 allows fixation of lock cams or cylinder follower elements. As can be seen from the second exemplary embodiment (FIG. 4), the third exemplary embodiment (FIG. 5) and the fourth exemplary embodiment (FIG. 6), only one single type of cylinder core 1 needs to be provided to operate different types of lock cams or cylinder follower elements. In the different exemplary embodiments, only the cam connector side 19 of the adapter element 15 differs. Therefore, it is obvious that a huge number of different locks 2 can be realized with only one single type of cylinder core 1 such that the huge variation of different locks 2 can be provided for low costs.

The adapter element 15 also provides a locking element 21. With the locking element 21, the cylinder core 1 is connected to the cylinder body 14 in a form-locking manner. Therefore, the manufacturing process of the lock 2 is kept simple to save costs.

Finally, FIG. 7 illustrates how the different components need to be put together to achieve a lock 2. First, a key profile insert 3 needs to be provided. As can be seen from FIG. 7, the key profile insert 3 can have different key ways 9 such that a lot of different locks 2 can be realized. The key profile insert 3 is described in very detail with reference to FIG. 2.

The key profile insert 3 is inserted into the cylinder core body 4. The cylinder core body 4 is a standardized element which is equal for any kind of different locks 2. The cylinder core body 4 is described with reference to FIG. 1 and FIG. 2.

By inserting the key profile insert 3 into the cylinder core body 4, the cylinder core 1 is created. The cylinder core 1 is combined with the adapter element 15. This combination is described with reference to FIGS. 3, 4, 5, and 6. In order to create the lock 2, the cylinder core 1 is inserted into the cylinder body 14 from the one side while the adapter element 15 is inserted into the cylinder body 14 from the other side. In this way, the cylinder core 1 is fixed within the cylinder body 14 in a form-locking manner.

As can be seen especially from FIG. 2 and FIG. 7, the inventive lock 2 provides protection of the cylinder core 1 against opening by abuse related to pulling out the cylinder core 1 from the cylinder body 14. In general, locks can be opened by forcibly pulling out the cylinder core 1 by inserting a screw into the key way 3 and applying a pulling force to this screw. However, if this is performed with the inventive lock 2, only the key profile insert 3 can be pulled out of the cylinder core body 4. In this specific embodiment, only three core pins are broken in this process, i.e. the three first core pins 5. Nevertheless, the three second core pins 6 still prevent the cylinder core 1 to be rotated. Therefore, the lock 2 cannot be opened.

The inventive cylinder core 1 and the inventive lock provides several benefits. On the one hand, the inventive cylinder core 1 allows to realize a various number of different locks 2 for low costs. Additionally, the inventive locks 2 are very safe and secure and withstand common ways to be opened by abuse.

The invention claimed is:

1. Cylinder core for a cylinder for locks, comprising:

a key profile insert inserted in a cylinder core body, the key profile insert having at least one first core pin and the cylinder core body having a first pin channel, a second pin channel, and at least one second core pin, the key profile insert further including a positioning element configured to prevent rotation of the key profile insert relative to the cylinder core body;

wherein the first pin channel aligns with the first core pin and the second pin channel guides the second core pin; and wherein the first core pin and the second core pin are movable within the first pin channel and the second pin channel by a key which is insertable into the cylinder core.

2. Cylinder core according to claim 1, wherein only the key profile insert defines a key way, which only allows a key adapted to the key way to be inserted into the cylinder core.

3. Cylinder core according to claim 1, wherein the core body comprises a key guiding part for guiding a key through the core body and the key profile insert.

4. Cylinder core according to claim 1, wherein the positioning element is provided within a positioning channel of the cylinder core body.

5. Cylinder core according to claim 1, wherein the key profile insert comprises at least one guiding pin, wherein the guiding pin is orientated perpendicular to the first core pin and insertable into a hole of the cylinder core body.

6. Cylinder core according to claim 1, wherein the key profile insert comprises at least one fixing pin, wherein the fixing pin prevents movement of the key profile insert relative to the cylinder core body.

7. Lock, comprising a cylinder core according to claim 1, further comprising a cylinder body for housing the cylinder core and an adapter element allowing connection of the cylinder core with a lock cam or a cylinder follower element.

8. Lock according to claim 7, wherein the adapter element comprises at least one mounting hole for fixing the adapter element to the cylinder core.

9. Lock according to claim 8, wherein the cylinder core comprises at least one thread aligning with the mounting hole of the adapter element.

10. Lock according to claim 7, wherein the adapter element comprises at least one protrusion, which is provided within a recess of the cylinder core.

* * * * *